US007955498B2

(12) United States Patent
Driver et al.

(10) Patent No.: US 7,955,498 B2
(45) Date of Patent: Jun. 7, 2011

(54) REDUCTION OF ORGANIC HALIDE CONTAMINATION IN HYDROCARBON PRODUCTS

(75) Inventors: Michael S. Driver, San Francisco, CA (US); Saleh A. Elomari, Fairfield, CA (US); Hye-Kyung C. Timken, Albany, CA (US)

(73) Assignee: Chevron, U.S.A. Inc., San Ramon, CA (US)

( * ) Notice: Subject to any disclaimer, the term of this patent is extended or adjusted under 35 U.S.C. 154(b) by 353 days.

(21) Appl. No.: 12/336,240

(22) Filed: Dec. 16, 2008

(65) Prior Publication Data

US 2010/0147746 A1 Jun. 17, 2010

(51) Int. Cl.
*C07C 7/00* (2006.01)

(52) U.S. Cl. ..... 208/262.1; 585/833; 585/855

(58) Field of Classification Search ..... None
See application file for complete search history.

(56) References Cited

U.S. PATENT DOCUMENTS 2,463,768 A * 3/1949 Hepp ..... 585/727
2,833,836 A * 5/1958 Linn ..... 585/842
4,122,245 A 10/1978 Nardi et al.
4,585,838 A 4/1986 Wang et al.
5,645,713 A * 7/1997 Yan ..... 208/308
5,731,101 A 3/1998 Sherif et al.
5,750,455 A 5/1998 Chauvin et al.
5,928,500 A * 7/1999 Richard et al. ..... 208/262.1
6,028,024 A 2/2000 Hirschauer et al.
6,235,959 B1 * 5/2001 Hirschauer et al. ..... 585/709
6,797,853 B2 9/2004 Houzvicka et al.
2003/0060359 A1 3/2003 Olivier-Bourbigou et al.
2004/0077914 A1 4/2004 Zavilla et al.
2004/0133056 A1 7/2004 Liu et al.
2008/0142412 A1 6/2008 Driver et al.

OTHER PUBLICATIONS

PCT/US2009/067894Search Report and Written Opinion, International Filing Date Dec. 14, 2009, 6 pages.

A.K. Roebuck et.al., Isobutane-Olefin Alklation with Inhibited Aluminum Chloride Catalysts, Industrial & Engineering Chemistry Product Research and Development, 1970, pp. 76-82, vol. 9-1, ACS Publications, Washington, USA.

* cited by examiner

*Primary Examiner* — Tam M Nguyen
(74) *Attorney, Agent, or Firm* — Susan Abernathy; Steven H. Roth

(57) ABSTRACT

A method for reducing halide concentration in a hydrocarbon product having an organic halide content which is made by a hydrocarbon conversion process using a halogen-containing acidic ionic liquid catalyst comprising contacting at least a portion of the hydrocarbon product with an aqueous caustic solution under conditions to reduce the halide concentration in the hydrocarbon product is disclosed.

25 Claims, No Drawings

REDUCTION OF ORGANIC HALIDE CONTAMINATION IN HYDROCARBON PRODUCTS

FIELD OF THE INVENTION

The present invention relates to methods for reducing organic halide concentration in a hydrocarbon product made by a hydrocarbon conversion process using halogen-containing acidic ionic liquids.

BACKGROUND OF THE INVENTION

Ionic liquids are liquids that are composed entirely of ions. The so-called "low temperature" ionic liquids are generally organic salts with melting points under 100° C., often even lower than room temperature. Ionic liquids may be suitable for example for use as a catalyst and as a solvent in alkylation and polymerization reactions as well as in dimerization, oligomerization, acetylation, metatheses, and copolymerization reactions.

One class of ionic liquids is fused salt compositions, which are molten at low temperature and are useful as catalysts, solvents and electrolytes. Such compositions are mixtures of components which are liquid at temperatures below the individual melting points of the components.

Ionic liquids can be defined as liquids whose make-up is entirely comprised of ions as a combination of cations and anions. The most common ionic liquids are those prepared from organic-based cations and inorganic or organic anions. The most common organic cations are ammonium cations, but phosphonium and sulphonium cations are also frequently used. Ionic liquids of pyridinium and imidazolium are perhaps the most commonly used cations. Anions include, but not limited to, $BF_4^-$, $PF_6^-$, haloaluminates such as $Al_2Cl_7^-$ and $Al_2Br_7^-$, $[(CF_3SO_2)_2N)]^-$, alkyl sulphates ($RSO_3^-$), carboxylates ($RCO_2^-$) and many other. The most catalytically interesting ionic liquids for acid catalysis are those derived from ammonium halides and Lewis acids (such as $AlCl_3$, $TiCl_4$, $SnCl_4$, $FeCl_3$ . . . etc). Chloroaluminate ionic liquids are perhaps the most commonly used ionic liquid catalyst systems for acid-catalyzed reactions.

Examples of such low temperature ionic liquids or molten fused salts are the chloroaluminate salts. Alkyl imidazolium or pyridinium chlorides, for example, can be mixed with aluminum trichloride ($AlCl_3$) to form the fused chloroaluminate salts. The use of the fused salts of 1-alkylpyridinium chloride and aluminum trichloride as electrolytes is discussed in U.S. Pat. No. 4,122,245.

Other examples of ionic liquids and their methods of preparation may also be found in U.S. Pat. Nos. 5,731,101; 6,797,853 and in U.S. Patent Application Publications 2004/0077914 and 2004/0133056.

The alkylation of isobutane with butenes and ethylene in ionic liquids has been described in U.S. Pat. Nos. 5,750,455; 6,028,024; and 6,235,959

SUMMARY OF THE INVENTION

The present invention relates to a method for reducing halide concentration in a hydrocarbon product having an organic halide content which is made by a hydrocarbon conversion process using a halogen-containing acidic ionic liquid catalyst comprising contacting at least a portion of the hydrocarbon product with an aqueous caustic solution under conditions to reduce the halide concentration in the hydrocarbon product.

DETAILED DESCRIPTION

Hydrocarbon conversion processes using a halogen-containing acidic ionic liquid catalyst which will generally produce a hydrocarbon product having an organic halide impurity content, typically from 50 to 4000 ppm. Examples of such processes include alkylation of paraffins, alkylation of aromatics, polymerization, dimerization, oligomerization, acetylation, metatheses, copolymerization, isomerization, olefin hydrogenation, hydroformylation. The presence of organic halides in such products may be undesirable. The present process can be used to reduce the organic halide concentration in such hydrocarbon products.

The present process is being described and exemplified herein in large part by reference to alkylation processes using certain specific ionic liquid catalysts, but such description is not intended to limit the scope of the invention. The organic halide reduction processes described herein may be used for any hydrocarbon product having an organic halide content which are made by hydrocarbon conversion processes using ionic liquid catalysts comprising halogen-containing acidic ionic liquids as will be appreciated by those persons having ordinary skill based on the teachings, descriptions and examples included herein.

In an embodiment, the present process is an alkylation process comprising contacting a hydrocarbon mixture comprising at least one olefin having from 2 to 6 carbon atoms and at least one isoparaffin having from 3 to 6 carbon atoms with a halogen-containing acidic ionic liquid catalyst under alkylation conditions.

In general, a strongly acidic ionic liquid is necessary for paraffin alkylation, e.g. isoparaffin alkylation. In that case, aluminum chloride, which is a strong Lewis acid in a combination with a small concentration of a Bronsted acid, is a preferred catalyst component in the ionic liquid catalyst scheme.

As noted above, the acidic ionic liquid may be any acidic ionic liquid. In one embodiment, the acidic ionic liquid is a chloroaluminate ionic liquid prepared by mixing aluminum trichloride ($AlCl_3$) and a hydrocarbyl substituted pyridinium halide, a hydrocarbyl substituted imidazolium halide, trialkylammonium hydrohalide or tetraalkylammonium halide to make an ionic liquid of the general formulas A, B, C and D, respectively,

A

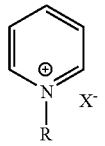

B

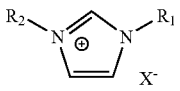

C

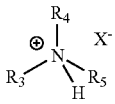

D

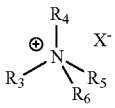

where R=H, methyl, ethyl, propyl, butyl, pentyl or hexyl group and X is a haloaluminate and preferably a chloroaluminate, and $R_1$ and $R_2$=H, methyl, ethyl, propyl, butyl, pentyl or hexyl group and where $R_1$ and $R_2$ may or may not be the same, and $R_3$, $R_4$, and $R_5$ and $R_6$=methyl, ethyl, propyl, butyl, pentyl or hexyl group and where $R_3$, $R_4$, $R_5$ and $R_6$ may or may not be the same.

In an embodiment, the acidic ionic liquid is selected from the group consisting of 1-butyl-4-methyl-pyridinium chloroaluminate, 1-butyl-pyridinium chloroaluminate, 1-butyl-3-methyl-imidazolium chloroaluminate and 1-H-pyridinium chloroaluminate. In an embodiment the ionic liquid catalyst is a quaternary ammonium chloroaluminate ionic liquid having the general formula RR' R" N $H^+$ $Al_2Cl_7^-$, wherein RR' and R" are alkyl groups containing 1 to 12 carbons. Examples of quaternary ammonium chloroaluminate ionic liquid salts are N-alkyl-pyridinium chloroaluminate, N-alkyl-alkylpyridinium chloroaluminate, pyridinium hydrogen chloroaluminate, alkylpyridinium hydrogen chloroaluminate, di-alkyl-imidazolium chloroaluminate, tetra-alkyl-ammonium chloroaluminate, tri-akyl-ammonium hydrogen chloroaluminate, or a mixture thereof.

An alkyl halide is optionally added to the ionic liquid catalyst and acts to promote the alkylation by reacting with aluminum chloride to form the prerequisite cation ions in similar fashion to the Friedel-Crafts reactions. The alkyl halides that may be used include alkyl bromides, alkyl chlorides and alkyl iodides. Preferred are isopentyl halides, isobutyl halides, butyl halides, propyl halides and ethyl halides. Alkyl chloride versions of these alkyl halides are preferable when chloroaluminate ionic liquids are used as the catalyst systems. Other alkyl chlorides or halides having from 1 to 8 carbon atoms may be also used. The alkyl halides may be used alone or in combination.

A metal halide may be employed to modify the catalyst activity and selectivity. The metal halides most commonly used as inhibitors/modifiers in aluminum chloride-catalyzed olefin-isoparaffin alkylations include NaCl, LiCl, KCl, $BeCl_2$, $CaCl_2$, $BaCl_2$, $SrCl_2$, $MgCl_2$, $PbCl_2$, CuCl, $ZrCl_4$ and AgCl, as described by Roebuck and Evering (Ind. Eng. Chem. Prod. Res. Develop., Vol. 9, 77, 1970). Preferred metal halides are CuCl, AgCl, $PbCl_2$, LiCl, and $ZrCl_4$.

HCl or any Bronsted acid may be employed as co-catalyst to enhance the activity of the catalyst by boasting the overall acidity of the ionic liquid-based catalyst. The use of such co-catalysts and ionic liquid catalysts is disclosed in U.S. Published Patent Application Nos. 2003/0060359 and 2004/0077914. Other co-catalysts that may be used to enhance the activity include IVB metal compounds preferably IVB metal halides such as $ZrCl_4$, $ZrBr_4$, $TiCl_4$, $TiCl_3$, $TiBr_4$, $TiBr_3$, $HfCl_4$, $HfBr_4$ as described by Hirschauer et al. in U.S. Pat. No. 6,028,024.

For example, in the process of producing alkylate hydrocarbon gasoline using haloaluminate ionic liquid catalysts, trace amounts of organic halides are found in the alkylate hydrocarbon. Removal of organic halides from gasoline is desirable to meet product specifications. Analogous results will occur, of course, when ionic liquid catalysts containing halides other than chlorides are used.

In an embodiment in which the ionic liquid catalyst contains chlorides, the organic halides that contaminate the resulting product are organic chlorides. In an embodiment, the chloride content in an alkylate hydrocarbon stream prepared using a chloroaluminate ionic liquid catalyst is from 50 ppm to 4000 ppm. Removal of trace organic chlorides from alkylate is also desirable since organic chlorides may generate corrosive or harmful material such as HCl or dioxins during combustion.

In an embodiment of the present process, a heated aqueous caustic solution is used to remove organic halides from the hydrocarbon product. In an embodiment, at least a portion of a hydrocarbon product from an acidic ionic liquid catalyzed hydrocarbon conversion process is contacted with an aqueous solution of caustic at an elevated temperature. In an embodiment the caustic is selected from Group I and Group II metal hydroxide solutions, other Bronsted basic compounds and their mixtures. Examples include LiOH, NaOH, KOH, RbOH, CsOH, or FrOH, $Mg(OH)_2$, $Ba(OH)_2$ or other Bronsted basic compounds. In an embodiment, concentration of caustic ranges from 0.3 wt % to 40 wt %, or 0.001M to 10 M solution or 0.001 N to 10 N. In an embodiment, the pH of the caustic solution is from 11 to 14. In an embodiment, the solvent for the caustic solution is water or deionized water. Other suitable solvents known in the art may be employed.

In an embodiment the caustic and hydrocarbon product are contacted at temperatures of from 20° C. to 300° C.

In an embodiment the caustic is heated to a temperature of from 50° C. to 400° C. at which the caustic solution is used to contact the hydrocarbon product. In an embodiment the caustic and hydrocarbon product are contacted at temperatures of from 20° C. to 300° C.

A pressure ranging from atmospheric pressure to 1000 psig may be used to maintain the hydrocarbon and the caustic solution in liquid phases in part and to improve the contact of two liquid phases.

In an embodiment, the relative amounts of caustic solution to the hydrocarbon stream are in the ranges 5:95 to 95:5 volumetric from which organic halide is removed. In an embodiment, relative volumes of caustic to hydrocarbon are from 5 vol % to 50 vol % or more. In an embodiment, the caustic solution and hydrocarbon are well mixed.

In an embodiment, alkylate gasoline products produced by an alkylation process comprising contacting a hydrocarbon mixture comprising at least one olefin having from 2 to 6 carbon atoms and at least one isoparaffin having from 3 to 6 carbon atoms with a halogen-containing acidic ionic liquid catalyst under alkylation conditions are contacted with a heated aqueous caustic wash as a final clean-up step to minimize the amount of alkyl chlorides in the alkylate gasoline product. In an embodiment, solutions of KOH and NaOH at a temperature of 200° C. are used to contact the alkylate gasoline.

In an embodiment, no degradation of alkylate quality is detected and it is found that hot caustic washing does not degrade the C8 content of the alkylate product.

In an embodiment, after hot caustic treatment, treated product is recovered. Any means of separating the used caustic solution from the hydrocarbon product may be used. Examples include decantation, gravity separation, settler based on gravity, extractor and others that are known in the art.

A Karl-Fischer analysis of alkylate products before and after hot caustic treatment demonstrated that the present process does not increase water content of alkylate product. In an embodiment, water content remained at approximately 30 ppm before and after treatment.

In addition, washing of the alkylate product after caustic treatment with water and testing the pH indicated that no caustic was carried over into alkylate gasoline products.

Another advantage of the present process is that it may remove any other extractable impurities such as catalyst residue that may be in the alkylate gasoline products.

Processes in accordance with the invention may be conducted as batch, semi-continuous or continuous processes.

EXAMPLES

The following Examples are illustrative of the present invention, but are not intended to limit the invention in any way beyond what is contained in the claims which follow.

Example 1

Reduction of Chloride by Hot Caustic Treatment in Batch Tests

A 300 mL Hastelloy-C autoclave was charged with 112.5 mL of alkylate gasoline containing between 1250 to 1313 ppm of chloride. Subsequently, 37.5 mL of aqueous caustic solution of either potassium hydroxide (KOH) or sodium hyrdoxide (NaOH) ranging from 2.0 wt % to 35.9 wt % was added to the autoclave. The autoclave was sealed and the contents were stirred at 1500 RPM. The mixture was then heated to the between 100° C. and 250° C. for 30 minutes. The stirring was stopped and the autoclave and its contents were allowed to cool to room temperature. The autoclave was opened and the alkylate gasoline layer was collected and analyzed by X-ray fluorescence spectroscopy (XRF) and by gas chromatography. The XRF measurement showed that the chloride level of the gasoline sample had been reduced as shown in Table 1. The gas chromatograph showed that the alkylate gasoline sample was not degraded during the caustic treatment process. Subsequent washing of the alkylate gasoline phase with deionized water after treatment showed no caustic solution was present in the hydrocarbon phase.

TABLE 1

Reduction of Chloride by Hot Caustic Treatment in Batch Tests

| Caustic Solution | Treatment Temperature | Initial Cl concentration | % Cl Reduction by XRF |
|---|---|---|---|
| 35.9 wt % KOH | 150° C. | 1253 ppm | 61.4% |
| 21.9 wt % KOH | 150° C. | 1253 ppm | 75.1% |
| 5.3 wt % KOH | 100° C. | 1253 ppm | 68.7% |
| 5.3 wt % KOH | 150° C. | 1253 ppm | 80.4% |
| 5.3 wt % KOH | 200° C. | 1313 ppm | 97.8% |
| 3.8 wt % NaOH | 100° C. | 1253 ppm | 64.1% |
| 3.8 wt % NaOH | 150° C. | 1253 ppm | 81.1% |
| 2.0 wt % NaOH | 150° C. | 1313 ppm | 80.8% |
| 2.0 wt % NaOH | 200° C. | 1313 ppm | 97.6% |
| 2.0 wt % NaOH | 250° C. | 1313 ppm | 98.8% |

Example 2

Control Experiments for Chloride Reduction by Caustic Treatment

A 300 mL Hastelloy-C autoclave was charged with 112.5 mL of alkylate gasoline containing 1253 ppm of chloride. Subsequently, 37.5 mL of aqueous caustic solution of 35.9 wt % potassium hydroxide (KOH) was added to the autoclave. The autoclave was sealed and the contents were stirred at 1500 RPM. The mixture was stirred at room temperature (17° C.) for 30 minutes. The stirring was stopped and the alkylate gasoline layer was collected and analyzed by X-ray fluorescence spectroscopy (XRF) and by gas chromatography. The XRF measurement showed that the chloride level of the gasoline sample was reduced by 5%.

A 300 mL Hastelloy-C autoclave was charged with 150 mL of alkylate gasoline containing 1253 ppm of chloride. The autoclave was sealed and the contents were stirred at 1500 RPM. The mixture was heated to 150° C. for 30 minutes. The stirring was stopped and the autoclave and its contents were allowed to cool to room temperature. The alkylate gasoline layer was collected and analyzed by X-ray fluorescence spectroscopy (XRF) and by gas chromatography. The XRF measurement showed that the chloride level of the gasoline sample had not been reduced.

Example 3

De-Chlorination of Conjunct Polymers by Hot Caustic Treatment

In 1-liter glass reaction flask equipped with a reflux condenser and an over-head stirrer, conjunct polymers recovered from the regenerated ionic liquid catalyst were refluxed (heated at reflux) in various aqueous KOH solutions for 2-3 hrs. Then, the reaction mixture was cooled to room temperature and the hydrocarbon was separated from the aqueous layer and dried over magnesium sulfate. The organic phase was then analyzed for chlorides and sulfur contents and for olefinicity by bromine number analysis. The table below compares the conjunct polymers before and after the KOH treatment at different KOH strengths.

TABLE 2

| | $Br_2$# | Sulfur | Chloride |
|---|---|---|---|
| Starting material | 30 | 147 ppm | 361 ppm |
| 1M KOH treatment | 33 | 132 ppm | 114 ppm |
| 2M KOH treatment | 32 | 108 ppm | 106 ppm |
| 3M KOH treatment | 61 (56)* | 196 (254)* ppm | 144 (370)* ppm |
| 5M KOH treatment | 32 | 100 | 116 ppm |

*the conjunct polymers for this run were from a different lot and the values in Parentheses are before treatment

Example 4

To de-chlorinate the conjunct polymers, they were treated with hot caustic by heating the conjunct polymers to reflux in an aqueous hydroxide ion solution. In an aspect, this aqueous hydroxide ion solution was 3 M aqueous KOH solution. The reflux was carried out for 2-3 hours. The treatment resulted in 65% chloride reduction. The treatment with hot 3 M KOH also resulted in some de-sulfurization of the conjunct polymers where sulfur levels dropped by ~23-33%. Table 3 below shows a comparison between the levels of chloride and sulfur before and after the hot caustic treatment. There was slight upward shift in the bromine number reflecting the elimination of hydrochloride which leads to making of more double bonds.

TABLE 3

| | Run 1 | Run2 |
|---|---|---|
| Chloride before KOH | 370 | 351 |
| Chloride after KOH | 144 | 120 |
| Sulfur Before KOH | 254 | 143 |
| Sulfur after KOH | 196 | 95 |
| Bromine# before KOH | 58 | 30 |

TABLE 3-continued

| | Run 1 | Run2 |
|---|---|---|
| Bromine# after KOH | 62 | 33 |
| Color before KOH | Dark Amber | Dark amber |
| Color after KOH | Light Amber | Dark amber |

What is claimed is:

1. A method for reducing halide concentration in a hydrocarbon product having an organic halide content which is made by a hydrocarbon conversion process using a halogen-containing acidic ionic liquid catalyst comprising contacting at least a portion of the hydrocarbon product with an aqueous caustic solution having a concentration of caustic that is 5.3 wt % or less under conditions to reduce the organic halide content in the hydrocarbon product.

2. The method according to claim 1, wherein the hydrocarbon conversion process is selected from the group consisting of alkylation, polymerization, dimerization, oligomerization, acetylation, metatheses, copolymerization, isomerization, olefin hydrogenation, hydroformylation and combinations thereof.

3. The method according to claim 1, wherein the aqueous caustic solution is selected from Group I and Group II metal hydroxide solutions, other Bronsted basic compounds and their mixtures.

4. The method according to claim 1, wherein the aqueous caustic solution is selected from the group consisting of LiOH, NaOH, KOH, RbOH, CsOH, or FrOH, $Mg(OH)_2$, $Ba(OH)_2$ and their mixtures.

5. The method according to claim 1, wherein the conditions include an elevated temperature.

6. The method according to claim 5, wherein the elevated temperature is from 20° C. to 300° C.

7. The method according to claim 5, wherein the elevated temperature is 150° C. or greater.

8. The method according to claim 5, wherein the elevated temperature is 200° C. or greater.

9. The method according to claim 1, wherein the concentration of caustic ranges from 0.3 wt % to 5.3 wt % and the relative volumes of caustic to hydrocarbon are from 5 vol % to 50 vol %.

10. An alkylation process comprising contacting a first hydrocarbon feed comprising at least one olefin having from 2 to 6 carbon atoms and a second hydrocarbon feed comprising at least one isoparaffin having from 3 to 6 carbon atoms with a halogen-containing acidic ionic liquid catalyst under alkylation conditions to produce an alkylate having an organic halide content and contacting at least a portion of the alkylate with an aqueous caustic solution under conditions to reduce the organic halide content in the alkylate.

11. The alkylation process according to claim 10, wherein the aqueous caustic solution is selected from Group I and Group II metal hydroxide solutions, other Bronsted basic compounds and their mixtures.

12. The alkylation process according to claim 10, wherein the aqueous caustic solution is selected from the group consisting of LiOH, NaOH, KOH, RbOH, CsOH, or FrOH, $Mg(OH)_2$, $Ba(OH)_2$ or their mixtures.

13. The alkylation process according to claim 10, wherein the conditions to reduce the organic halide content in the alkylate include a temperature from 20° C. to 300° C.

14. The alkylation process according to claim 10, wherein the conditions to reduce the organic halide content in the alkylate include a temperature of 150° C. or greater.

15. The alkylation process according to claim 14, wherein the temperature is 250° C. or greater.

16. The alkylation process according to claim 10, wherein the acidic ionic liquid is selected from the group consisting of 1-butyl-4-methyl-pyridinium chloroaluminate, 1-butyl-pyridinium chloroaluminate, 1-butyl-3-methyl-imidazolium chloroaluminate, 1-H-pyridinium chloroaluminate and their mixtures wherein the ionic liquid catalyst is a quaternary ammonium chloroaluminate ionic liquid having the general formula RR' R" N H+Al2Cl7-, wherein RR' and R" are alkyl groups containing 1 to 12 carbons.

17. The alkylation process according to claim 10, wherein the ionic liquid catalyst is a quaternary ammonium chloroaluminate ionic liquid having the general formula RR' R" N $H^+Al_2Cl_7^-$, wherein RR' and R" are alkyl groups containing 1 to 12 carbons.

18. The method of claim 1, wherein the contacting does not degrade the hydrocarbon product.

19. The method of claim 1, wherein the hydrocarbon product comprises a gasoline.

20. The method according to claim 1, wherein the concentration of caustic is 0.3 wt % to 5.3 wt %.

21. The method according to claim 1, additionally comprising separating the aqueous caustic solution from the alkylate by decantation or gravity separation.

22. The alkylation process of claim 10, wherein the contacting the at least the portion of the alkylate with the aqueous caustic solution does not degrade a C8 content of the alkylate.

23. The alkylation process of claim 10, wherein the aqueous caustic solution has a concentration of caustic that is 5.3 wt % or less.

24. The alkylation process of claim 23, wherein the concentration of caustic is 0.3 wt % to 5.3 wt %.

25. The alkylation process of claim 10, additionally comprising separating the aqueous caustic solution from the hydrocarbon product by decantation or gravity separation.

* * * * *